United States Patent [19]

Woods

[11] Patent Number: 4,532,389

[45] Date of Patent: Jul. 30, 1985

[54] ELECTRIC CIRCUIT CONTROLLING DEVICE AND METHOD OF OPERATING

[75] Inventor: Lee O. Woods, Morrison, Ill.

[73] Assignee: General Electric Company, Fort Wayne, Ind.

[21] Appl. No.: 505,493

[22] Filed: Jun. 17, 1983

[51] Int. Cl.[3] ..... H01H 35/34

[52] U.S. Cl. ..... 200/83 P; 200/81.4; 200/83 J; 200/83 S

[58] Field of Search ..... 200/81 R, 81.4, 83 R, 200/83 WM, 83 B, 83 A, 83 C, 83 D, 83 P, 83 S, 83 SA

[56] References Cited

U.S. PATENT DOCUMENTS

| | | | |
|---|---|---|---|
| 3,210,486 | 10/1965 | Holzer | 200/81 R |
| 4,048,455 | 9/1977 | Forsythe et al. | 200/81.4 |
| 4,091,249 | 5/1978 | Huffman | 200/83 P |
| 4,200,776 | 4/1980 | Poling | 200/83 P |
| 4,346,272 | 8/1982 | Stoll | 200/83 C |
| 4,458,117 | 7/1984 | Johnson | 200/83 P |
| 4,464,551 | 8/1984 | Johnson | 200/83 P |

*Primary Examiner*—J. R. Scott

*Attorney, Agent, or Firm*—Joseph E. Papin

[57] ABSTRACT

An electrical circuit controlling device has a housing with snap action means therein adapted for successive discrete snap action movements. Means is movable in the housing for selectively transmitting a force at different preselected levels onto the snap action means to effect the successive discrete snap action movements thereof. An actuating member is movable in the housing and rockably engaged between the snap action member and a pair of switch elements to successively operate them between circuit controlling modes in response to the successive discrete snap action movements of the snap action means, respectively. A method of operating an electric circuit controlling device is also disclosed.

29 Claims, 10 Drawing Figures

ELECTRIC CIRCUIT CONTROLLING DEVICE AND METHOD OF OPERATING

CROSS-REFERENCE TO RELATED APPLICATION

This application is related to the commonly assigned Ronald L. Johnson application Ser. No. 378,485 filed May 14, 1982 (now U.S. Pat. No. 4,464,551 issued Aug. 7, 1984) which is incorporated herein by reference.

FIELD OF THE INVENTION

This invention relates in general to electric circuit controlling devices and in particular to such devices adapted for use in electric circuits of vehicles as well as a method of operating such devices.

BACKGROUND OF THE INVENTION

In the past, various different types of switching devices were utilized to effect multiple switching operations as may be necessary to control a circuit, such as may be employed in an automotive vehicle for instance. In one of the past vehicle applications, the switching or electrical circuit controlling device was employed to control a power brake system. During the operation of the power brake system, the switching device was operable to control the cycling of a pump mechanism so as to control the reservoir pressure from which the power brake system was operated. In another past vehicle application, a similar switching device was employed to control an automotive type air conditioning system. In such an automotive type air conditioning system these past switching devices were subjected to the high side pressure of the system for controlling a fan circuit of such system as well as the speed of the fan.

In one of the past switching devices, a single snap action member was operable through two successive discrete snap action movements from a stable configuration toward two unstable configurations thereof for effecting the operation of two switches at different settings to accomplish multiple circuit controlling functions. While these past switching devices undoubtedly had many salient features, it would be especially desirable and advantageous to incorporate into such past switching devices an improved switching arrangement and also an improved arrangement for actuating such switching arrangement in response to the successive discrete snap action movements of the single snap action member.

SUMMARY OF THE INVENTION

Among the several objects of the present invention may be noted the provision of an improved electric circuit controlling device and an improved method of operating such which at least in part incorporate the above discussed advantageous and desirable features; the provision of such improved device and method in which an actuating member is rockably or pivotally movable to transmit successive discrete snap action movements from a snap action member to switching means of such devices; the provision of such improved device and method in which the actuating member is arranged in pivotal bridging engagement between a pair of switch elements of the switching means; the provision of such improved device and method in which the switch elements are pivotally movable toward a circuit controlling position with one of the switch elements being engaged with a fulcrum during its pivotal movement toward the circuit controlling position thereof; and the provision of such improved device and method in which the component parts utilized therein are simplistic in design, economically manufactured and easily assembled. These as well as other objects and advantageous features of the present invention will be in part apparent and in part pointed out hereinafter.

In general, an electric circuit controlling device in one form of the invention has a housing with snap action means therein operable generally for successive snap action movements from a stable configuration toward a pair of unstable configurations thereof, and a pair of switch elements are pivotally movable in the housing for switching between a pair of circuit controlling modes, respectively. Actuating means is movable in the housing and pivotally arranged between the snap action means and the switch elements for effecting successive pivotal movements of the switch elements between a pair of circuit controlling modes thereof, respectively. The actuating means is initially movable to effect the pivotal movement of at least one of the switch elements from one of the circuit controlling modes toward the other thereof upon the discrete snap action movement of the snap action means from the stable configuration toward one of the unstable configurations thereof, and the actuating means is also thereafter further movable so as to pivot generally about the at least one switch element in its other circuit controlling modes to subsequently effect the pivotal movement of the other of the switch elements from one of the circuit controlling modes to the other thereof upon the successive discrete snap action movement of the snap action means from the one unstable configuration to the other of the unstable configurations thereof.

Also in general and in one form of the invention, an electric circuit controlling device has a housing with switch means therein including a pair of spaced apart switch elements movable generally between a pair of circuit controlling modes, respectively, and means is provided for pivotally mounting the switch member in the housing. Fulcrum means is located in the housing for abutment with one of the switch elements, and actuating means adapted for movement in the housing in response to an applied force thereon is arranged in pivotal bridging engagement with the switch elements, respectively. The actuating means is movable in response to the applied force acting thereon to initially move at least one of the switch elements generally about the pivotally mounting means of the switch member into engagement with the fulcrum means and then to further move a part of the at least one switch element generally about only the fulcrum means toward one of the circuit controlling modes of the at least one switch element, and the actuating means is also thereafter further pivotally movable in response to the applied force acting thereon generally about the at least one switch element in its one circuit controlling mode and in its abutment with the fulcrum means to move the other of the switch elements generally about the pivotally mounting means of the switch member toward one of the circuit controlling modes of the other switch element.

Further in general, a method of operating an electric circuit controlling device is provided in one form of the invention. The device has means for pivotally mounting a switch member therein with the switch member including a pair of spaced apart switch elements each having a free end portion and operable between a pair of circuit controlling modes, respectively, and actuating means is also provided in the device for pivotal bridging engagement between the switch elements, respectively. In practicing this method, the actuating means and at least one of the switch elements are generally conjointly moved, and the pivotal movement of the at least one switch element is effected thereby generally about the pivotally mounting means of the switch member to urge the free end portion of the at least one switch element toward one of the circuit controlling modes thereof. The actuating means is pivoted generally about its pivotal bridging engagement with the at least one switch element when the at least one switch element is in the one circuit controlling mode thereof, and the other of the switch elements is moved thereby generally about the pivotally mounting means of the switch member to urge the free end portion of the other switch element toward one of the circuit controlling modes thereof.

BRIEF DESCRIPTION OF THE DRAWINGS

Corresponding reference characters indicate corresponding parts throughout the several views of the drawings.

The exemplifications set out herein illustrate the preferred embodiments of the invention, and such exemplifications are not intended to be construed as limiting the scope of the disclosure or of the invention in any manner.

DETAILED DESCRIPTION OF THE PREFERRED EMBODIMENTS

Figure 4:
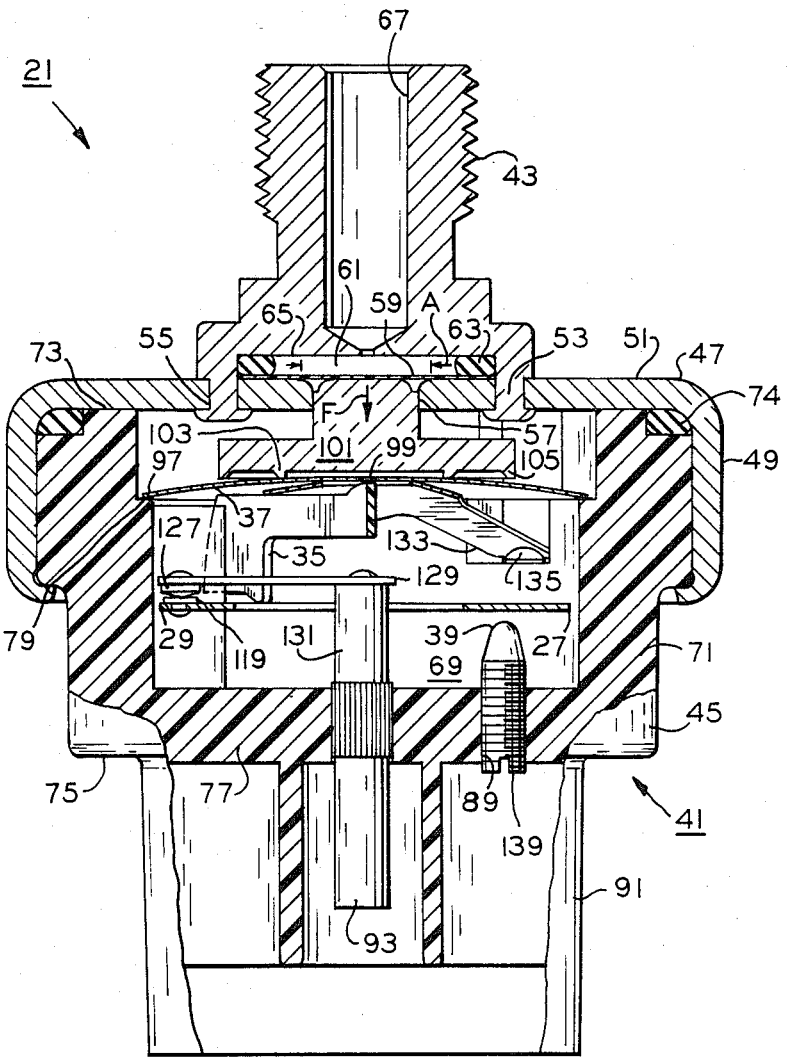
FIG. 4 is a partial sectional view taken along line 4—4 in FIG. 3.
Figure 5:
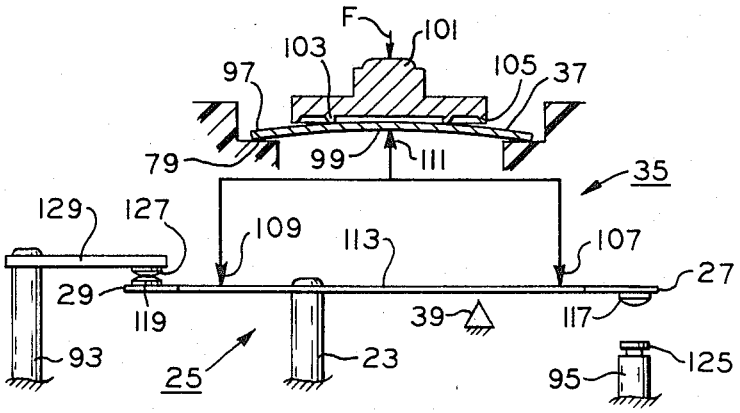
FIG. 5 is a schematic view of the force transmitting, snap action, switch actuating and switch element components of the device of FIG. 1, the view illustrating such components in their stable configurations with one of the switch elements in a closed circuit mode and the other of the switch elements in an open circuit mode.
Figure 6:
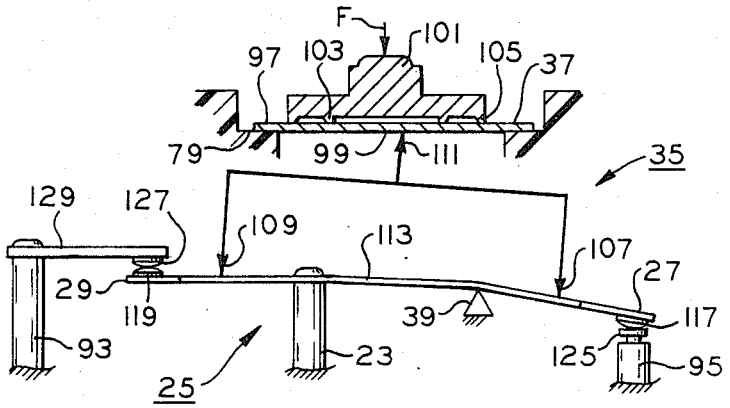
FIG. 6 is a schematic view of the components seen in FIG. 5, the components being shown in an unstable configuration with both the aforementioned one and other switch elements in the closed circuit modes thereof, respectively.
Figure 7:
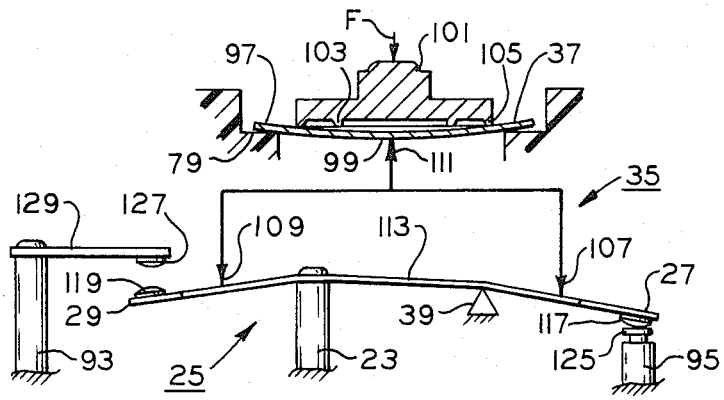
FIG. 7 is a schematic view of the components seen in FIG. 5, the components being shown in another unstable configuration with the aforementioned one switch element in the open circuit mode thereof and the aforementioned other switch element in the closed circuit mode thereof.

Referring now to the drawings in general, there is illustrated a method in one form of the invention for operating an electric circuit controlling device 21 (FIGS. 1–7). Device 21 has means, such as a terminal 23 or the like for instance, for pivotally mounting a switch member or switching means 25 therein with the switch member including a pair of generally laterally spaced apart switch elements 27, 29 each having a free end portion 31, 33 and operable generally between a pair of circuit controlling modes or positions (FIGS. 1 and 5–7). Actuating means or member 35 is also provided in device 21 for pivotal bridging engagement between switch elements 27, 29. In practicing this method of operating device 21, actuating member 35 and switch element 27 are moved generally conjointly, and the pivotal movement of switch element 27 is effected thereby generally about pivotally mounting means or terminal 23 to urge free end portion 31 of switch element 27 toward one of the circuit controlling modes thereof (FIG. 6). Actuating member 35 is thereafter pivoted or rocked generally about its pivotal bridging engagement with switch element 27 when it is in its one circuit controlling mode, and switch element 29 is moved thereby generally about terminal 23 to urge free end portion 33 of switch element 29 toward one of the circuit controlling modes thereof (FIG. 7).

Figure 1:
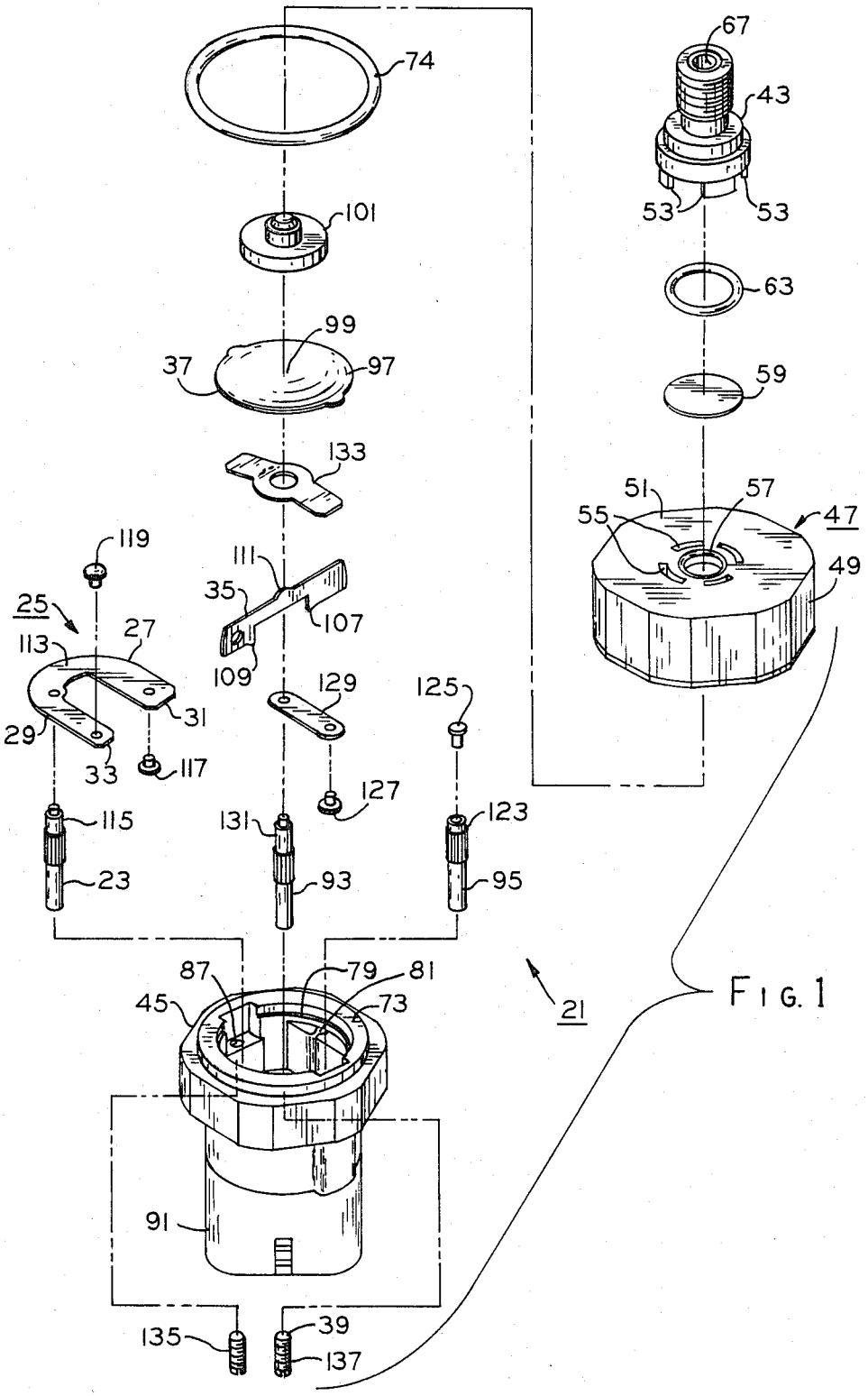
FIG. 1 is an exploded perspective view showing an electric circuit controlling device in one form of the invention and illustrating principles which may be practiced of a method of operating an electric circuit controlling device also in one form of the invention.
Figure 2:
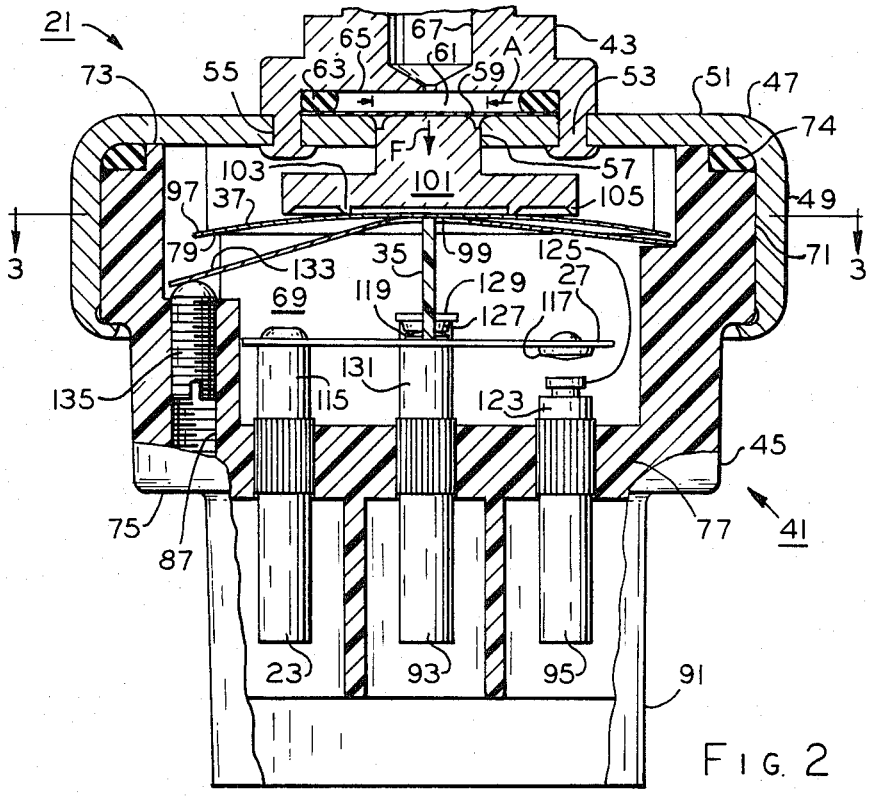
FIG. 2 is a sectional view showing the device of FIG. 1 in cross section.
Figure 3:
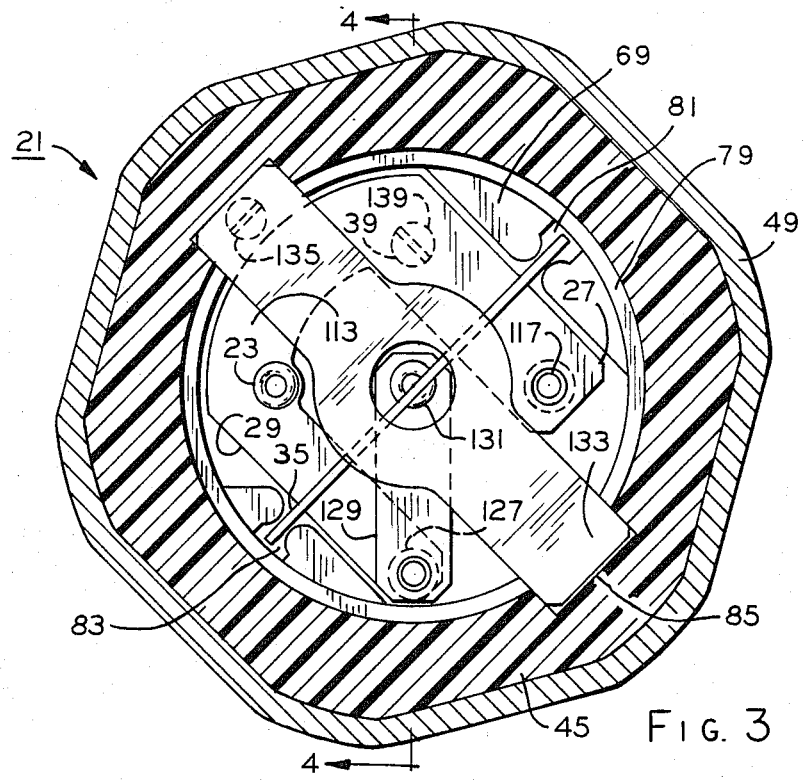
FIG. 3 is a sectional view taken along line 3—3 in FIG. 2.

More particularly and with specific reference to FIGS. 1–7, device 21 has a snap action means or member, such as a snap action disc 37 or the like for instance, disposed therein which may be built or shaped into the stable configuration seen in FIGS. 1 and 2 from a generally thin strip of sheet material, such as stainless steel for instance as well known in the art, and the snap action disc is adapted for discrete successive snap action movements from its stable configuration toward a pair of unstable configurations thereof, as discussed hereinafter and illustrated schematically in FIGS. 5–7. While the shape and construction of snap action disc 37 is illustrated herein for purposes of disclosure, it is contemplated that snap action members having various other shapes and constructions may be utilized within the scope of the invention so as to meet at least some of the objects thereof.

It may be noted that actuating member 35 is arranged in pivoting engagement between switch elements 27, 29 and snap action disc 37, respectively; therefore, when the snap action disc is actuated with its discrete snap action movement from the stable configuration to one of the unstable configurations thereof, the actuating member is both protractively moved and pivotally or rockably moved in response thereto, as best seen in FIGS. 5 and 6. Thus, the initial discrete snap action movement of snap action disc 37 exerts an applied force of an initial preselected level or value on actuating member 35. Switch element 27 and actuating member 35 are generally conjointly moved in response to the applied force at the preselected level thereof exerted on the actuating member, and the pivotal movement is effected thereby of the switch element generally about terminal 23 to which switch member 25 is mounted in device 21. During this pivotal movement of switch element 27 about terminal 23, the switch element is abutted or otherwise pivotally engaged with a fulcrum or fulcrum means 39 which is adjustably movable in device 21 for location in a preselected or adjusted position adjacent the switch element when switch member 25 is in its at-rest position. Of course, the lever arm defined generally between terminal 23 and the engagement of actuating member 35 with switch element 27 is shortened upon the engagement of the switch element with fulcrum 39 generally by the distance between the terminal and the fulcrum thereby to increase the resistance of the switch element to further movement by the actuating member. Subsequent to the abutment of switch element 27 with fulcrum 39, actuating member 35 and switch element 27 are further and generally conjointly moved in response to the applied force at the preselected level being exerted on the actuating member with a distal part of the switch element including free end portion 31 thereof being pivoted generally about the fulcrum. Therefore, in response to this further pivotal movement of switch element 27 about fulcrum 39, free end portion 31 of the switch element is urged or otherwise moved toward the closed circuit controlling position thereof.

When switch member 27 is disposed in its closed circuit controlling position and in its abutment with fulcrum 39, snap action disc 37 is further or successively actuated or displaced with discrete snap action movement from the one unstable configuration to the other of the unstable configurations thereof at another preselected level or value which is predeterminately greater than the preselected level at which the snap action member was initially actuated from the stable configuration to the one unstable configuration thereof, as discussed above. Thus, the successive discrete snap action movement of snap action disc 37 increases the applied force exerted on actuating member 35 to the preselected greater level. In response to this increased applied force, actuating member 35 is pivoted or rocked generally about its pivotal engagement with switch element 27 when the switch element is in its closed circuit controlling mode and in its abutment with fulcrum 39. Since actuating member 35 is disposed in pivotal bridging engagement between switch elements 27, 29, as previously mentioned, the pivoting of actuating member 35 about switch element 27 serves to move switch element 29, i.e., effect the pivotal movement thereof, generally about terminal 23 thus urging free end portion 33 of switch element 29 toward the open circuit controlling mode thereof. To conclude the description of the method of operating device 21, it may be noted that in either circuit controlling mode, switch elements 27, 29 may be disposed in a circuit making position or a circuit breaking position, respectively.

Referring again to the drawings in general and recapitulating at least in part with respect to the foregoing, device 21 is illustrated in one form of the invention as having a housing 41 with switch member 25 therein including switch elements 27, 29 movable generally between the closed and open circuit controlling modes thereof, respectively (FIGS. 1–4). Terminal 23 pivotally mounts switch member 25 in housing 41 (FIGS. 1–3) and fulcrum 39 is located in the housing for abutment with switch element 27 (FIGS. 1 and 4). Actuating member 35 is adapted for movement in housing 41 in response to an applied force thereon and is arranged in pivotal bridging engagement between switch element 27, 29 respectively (FIGS. 1 and 3). Adjusting member 35 is movable in response to the applied force acting thereon to initially move switch element 27 generally about terminal 23 into engagement with fulcrum 39 and then to further move a distal part of the switch element about only the fulcrum toward the closed circuit controlling mode of the switch element (FIG. 6). Actuating member 35 is also thereafter further pivotally movable in response to the applied force acting thereon generally about switch element 27 in its closed circuit controlling mode and in its abutment with fulcrum 39 to move or pivot switch element 29 generally about terminal 23 toward the open circuit controlling mode of switch element 29 (FIG. 7).

More particularly and with specific reference to FIGS. 1–4, housing 41 of device 21 includes a pair of housing members 43, 45 retained in assembly positions against displacement by suitable means, such as a generally cup-shaped retainer 47 or the like for instance. Retainer 47 includes a sleeve 49 which is deformed into gripping engagement about a confronting part of lower housing member 45 exteriorly thereof, and a generally radially extending wall 51 integral with the sleeve is disposed generally between housing members 43, 45. A plurality of integral projections 53 on upper housing member 41 detachably fit into a plurality of accommodating apertures 55 provided therefor through radial wall 51 of retainer 47 thereby to retain the upper housing member against displacement with respect to the retainer and lower housing member 45, and the apertures are spaced about a generally central circular opening 57 through the radial wall of the retainer. It is, of course, understood that housing members 43, 45 and retainer 47 may be formed of any suitable material, such as a resin, a metal or a metal alloy for instance; however, in the automotive vehicle application illustrated herein for device 21, lower housing member 45 is formed of thermoplastic material while upper housing member 43 and retainer 47 are formed of a rust resistance metal. Although housing members 43, 45 and retainer 47 are shown herein as having particular shapes and associated in a particular manner for purposes of disclosure, it is contemplated that other housing members and retainers having various other shapes and associated in different manners may be utilized within the scope of the invention so as to meet at least some of the objects thereof.

A generally resilient or flexible diaphragm or diaphragm means 59 of any suitable material is sealably interposed between upper housing member 43 and radial wall 51 of retainer 47 so as to define with the upper housing an expansible pressure fluid chamber 61 therein. A seal, such as an O-ring 63 or the like for instance, is disposed in sealing engagement between diaphragm 59 and an annular seating groove 65 provided therefor in upper housing member 43 to assist in sealing chamber 61 which is connected in pressure fluid communication with a control port 67 provided in the upper housing member. Diaphragm 59 is arranged generally in overlaying relation with radial wall 51 of retainer 47 about opening 57 therein, and an effective area A of the diaphragm is generally defined by the diameter of the diaphragm about which it may flex. Thus, effective area A of diaphragm 59 is subjected to established fluid pressure in chamber 61 to create applied force F for effecting the operation of device 21, as previously discussed.

Lower housing member 45 includes a plurality of walls or wall means which define with radial wall 57 of retainer 47 and diaphragm 59, a switch chamber 69 within the lower housing member, and the wall means plurality comprises a generally annular stepped sidewall 71 having a pair of opposite ends 73, 75 with a generally radially extending base wall 77 integrally formed with the sidewall adjacent opposite end 75 thereof. Upper opposite end 73 of sidewall 71 is abutted against radial wall 51 of retainer 47 having suitable sealing means, such as an O-ring 74 for instance, interposed therebetween, and sleeve 49 of the retainer is deformed into gripping engagement with a confronting part of the sidewall exteriorly of lower housing member 45, as previously mentioned. A generally annular shoulder or seat 79 is provided on sidewall 71 of lower housing member 45 so as to extend generally circumferentially thereabout within switch chamber 69 between opposite ends 73, 75 of the sidewall, and a pair of opposite generally vertically extending guide means or grooves 81, 83 are provided in the sidewall between base wall 77 thereof. A recess 85 is provided in housing seat 79, and a pair of threaded openings 87, 89 are provided in lower housing member 45 through base wall 77 thereof with threaded opening 87 being generally diametrically opposite recess 85 in switch chamber 69, as discussed hereinafter. If desired, a skirt 91 or the like may be formed with lower housing member 45 generally adjacent base wall 77 thereof so as to depend generally in protective relation about terminals 23, 93, 95 which are mounted by suitable means in the base wall.

Snap action disc 37 in its stable configuration includes a peripheral or marginal edge or edge portion 97 extending about a generally arcuate, dome or dome shaped section or portion 99, and the peripheral portion of the snap action disc is seated on seat 79 provided therefor in switch chamber 69 of housing 41. Means, such as a piston 101 or the like for instance, is movable in switch chamber 69 for transmitting to snap action disc 37 the applied force F created in response to established fluid pressure in control chamber 61 acting on the effective area A of diaphragm 59. Force transmitting means or piston 101 has one opposite end thereof guidably mounted for reciprocal movement in opening 57 of retainer 47 and arranged in driven engagement with diaphragm 59, and a pair of generally annular means, such as circular ridges 103, 105 or the like for instance, are predeterminately spaced apart on the other opposite end of the piston for selective driving engagement with the upper surface of dome section 99 on snap action disc 37. When snap action disc 37 is in its stable configuration as best seen in FIGS. 2 and 4, inner ridge 103 on pistion 101 is seated in driving engagement with dome section 99 of the snap action disc, and at other times as discussed in greater detail hereinafter, outer ridge 105 will be selectively drivingly engaged with the dome section of the snap action disc but at a different location thereon than ridge 103. Piston 101 may be formed of any suitable material, such as aluminum for instance, and while the piston is illustrated herein for purposes of disclosure, it is contemplated that other pistons having various other shapes and defining force applying or angular regions other than ridges 103, 105 may be utilized within the scope of the invention so as to meet at least some of the objects thereof.

Actuating member 35, made for instance from "Textolite", extends generally across switch chamber 69 and is guidably received in opposite grooves 81, 83 so as to be both rockably or pivotally movable and reciprocally movable in the grooves. To facilitate the rocking or pivoting movement of actuating member 35, it may be noted that a plurality of pivot sections 107, 109, 111 or the like for instance are integrally provided on the actuating member and arranged in pivoting engagement with switch elements 27, 29 and the lower surface of dome section 99 on snap action disc 37, respectively.

Switch member 25 comprises switch elements or arms 27, 29 arranged so as to extend generally in laterally spaced apart relation with each other and including a bridge portion 113 or means for integral interconnection between the switch elements and spaced from free end portions 31, 33 thereof, respectively. Bridge portion 113 of switch elements 27, 29 is pivotally mounted or otherwise secured by suitable means, such as riveting or swedging for instance, to a supporting section 115 of terminal 23 provided therefor in switch chamber 69, and it may be noted that the pivotal mounting engagement of the bridge portion with the terminal supporting section is arranged in spaced relation closer to switch element 29 than to switch element 27. Thus, switch elements 27, 29 are pivotally movable generally about the mounting engagement of switch member 25 with supporting section 115 of terminal 23, and the lever arm of the switch member defined by switch element 27 is greater than that defined by switch element 29 since the pivotal mounting engagement of the switch member with the terminal supporting section is spaced closer to switch element 29. While switch elements 27, 29 are disclosed herein as including integral bridge portion 113 thereby to define a generally U-shaped switch member 25, it is contemplated that the switch elements may be separate or mechanically interconnected as well as defining a switch member of a different shape within the scope of the invention so as to meet at least some of the objects thereof. Switch member 25 may be formed of any suitable material having the desired electrical and physical properties, such as beryllium copper for instance, and it is contemplated that at least one of switch elements 25, 27 may be made stiffer than the other by suitable means, such as being thicker in cross section or being ribbed or channeled for instance, within the scope of the invention so as to meet at least some of the objects thereof. A pair of electrical contacts 117, 119 are carried in opposite relation on switch elements 27, 29 adjacent free end portions 31, 33 thereof, respectively. In the at-rest position of switch member 25, contact 117 on switch element 27 is spaced or broken from a cooperating electrical contact 121 carried on a supporting section 123 of terminal 95 disposed within switch chamber 69 thereby to define an open controlling circuit mode of the switch element, and contact 119 on switch element 29 is made with an electrical contact 127 carried on an extension 129 mounted to a supporting section 131 of terminal 93 within the switch chamber thereby to define a closed circuit controlling mode of switch element 29.

Calibrating or adjustably movable means for device 21 includes a somewhat flexible relatively thin strap 133 having spring-like characteristics extending generally across switch chamber 69 and biased against the lower surface of dome section 99 on snap action member 37 in the switch chamber. One end of strap 133 is seated in recess 85 provided therefor in lower housing member 45, and the other opposite end of the strap is engaged by the end of an adjusting means, such as for instance a screw 135 or the like, threadedly received in threaded opening 87 provided therefor in base wall 77 of lower housing member 45. Thus, calibration may be achieved by adjusting screw 135 to increase or decrease an adjusting force exerted by strap 133 generally against dome section 99 of snap action disc 37. To complete the description of device 21, means, such as another screw 137 or the like for instance, is threadedly received in threaded opening 89 provided therefor in base wall 77 of lower housing member 45 so as to be adjustably movable therein toward a preselected position spaced from switch element 27 for abutment therewith, and the abutment means or screw 139 includes an end defining fulcrum 39 within switch chamber 69, as previously mentioned.

In the operation of device 21, assume that the component parts thereof are disposed in their respective at-rest positions, as shown in FIGS. 2–5, that adjusting means 133 has been adjusted to properly calibrate the device, and that adjusting screw 137 has been adjusted to predeterminately locate its fulcrum 39 adjacent switch element 27, as previously discussed. As a control fluid pressure is established in chamber 61 of device 21, the control fluid pressure acts on the effective area A of diaphragm 59 to create applied force F. Since the upper end of piston 101 is abutted with diaphragm 59 and since circular ridge 103 on the lower end of the piston is drivingly engaged with dome section 99 of snap action disc 37, the applied force F is transmitted from the diaphragm through the piston onto the snap action disc urging peripheral edge portion 97 thereof toward its seating engagement with seat 79 provided therefor on lower housing member 45.

As applied force F attains the initial preselected level thereof, piston 101 is moved in a creeping manner to cause snap action disc to snap or actuate from its stable configuration, as best seen in FIG. 5, to its one unstable configuration, as best seen in FIG. 6 and as discussed hereinbefore. Of course, upon the discrete snap action movement of snap action disc 37 from the stable configuration to the one unstable configuration thereof, piston 101 generally conjointly follows so as to also engage outer circular ridge 105 thereon with the snap action disc, as best seen in FIG. 6. Due to the pivotal engagement of pivotal sections 107, 109, 111 on actuating member 35 with switch elements 27, 29 and snap action member 37, respectively, actuating member 35 is rockably and protractively movable generally downwardly in response to the discrete snap action movement of the snap action member at the first preselected level of the applied force F to effect the operation of switch element 27 from its open circuit position, as seen in FIG. 5, to its closed circuit position, as seen in FIG. 6. During this operation of switch element 27, it is initially pivotally moved generally about the mounting engagement of switch member 25 with supporting section 115 of terminal 23 into abutment with fulcrum 39 on adjusting screw 137 in the preselected position thereof. Subsequent to the engagement of switch element 27 with fulcrum 39, the distal part of the switch element is thereafter pivoted generally about the fulcrum to make contact 117 carried adjacent free end portion 31 of the switch element with contact 125 on supporting section 123 of terminal 95. Of course, when contacts 117, 125 are made, switch element 27 is in the closed circuit position or mode thereof completing a circuit through device 21 between terminals 23, 95.

When the applied force F is increased to attain its greater preselected level, piston 101 is further moved in a creeping manner transmitting such applied force through outer circular ridge 105 thereon to snap action disc 37 to effect its actuation from the one unstable configuration, as best seen in FIG. 6, to the other unstable configuration thereof, as best seen in FIG. 7. Of course, upon this successive discrete snap action movement of snap action disc 37 between its unstable configurations, piston 101 generally conjointly follows. Since actuating member 35 is bridged between switch elements 27, 29, the actuating member is pivotally or rockably moved generally about the pivotal engagement of its pivotal section 107 engaged with switch element 27 in the closed circuit position thereof in response to the successive discrete snap action movement of snap action disc between its unstable configuration. This rocking movement of actuating member 35 generally about switch element 27 in its closed circuit position effects the operation of switch element 29 from its closed circuit position as best seen in FIG. 6, to its open circuit position, as best seen in FIG. 7. During this operation of switch element 29, it is pivotally moved generally about the mounting engagement of switch member 25 with supporting section 115 of terminal 23 so as to break contact 119 adjacent free end 33 of switch element 29 from contact 127 on extension 129 connected with supporting section 131 of terminal 93. Of course, when contacts 119, 127 are broken, switch element 29 is in the open circuit position thereof interrupting the circuit between terminals 23, 93 through device 21.

When the fluid pressure in chamber 61 is eliminated so as to eliminate applied force F or at least reduced to a preselected low value effecting a corresponding reduction in the applied force, the component parts of device 21 will return to their at-rest position as illustrated in FIGS. 2–4.

Figure 8:
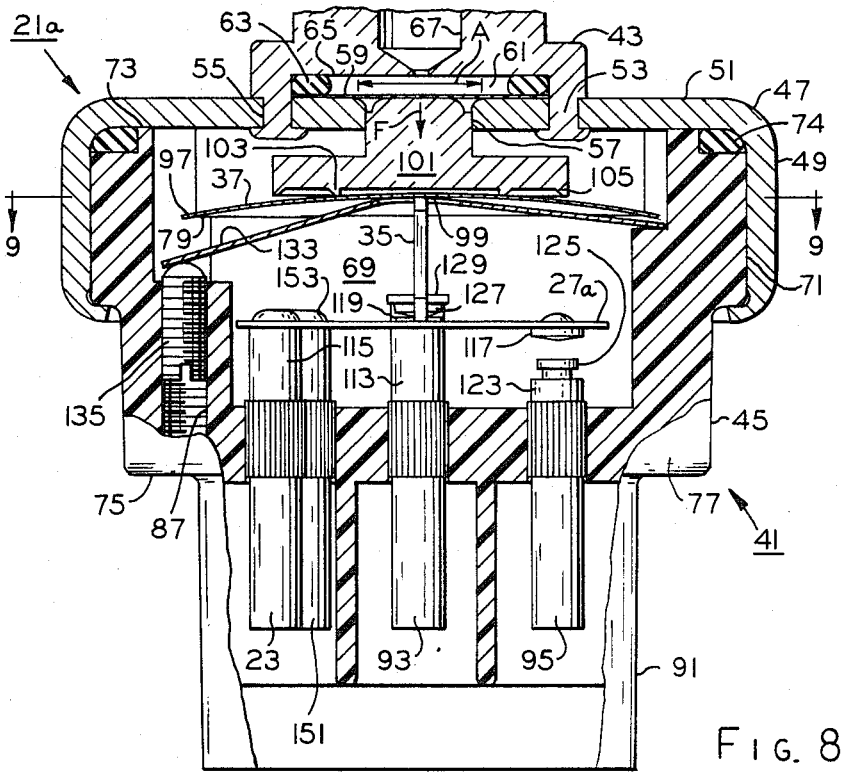
FIG. 8 is a partial sectional view showing an alternative electric circuit controlling device in one form of the invention.
Figure 9:
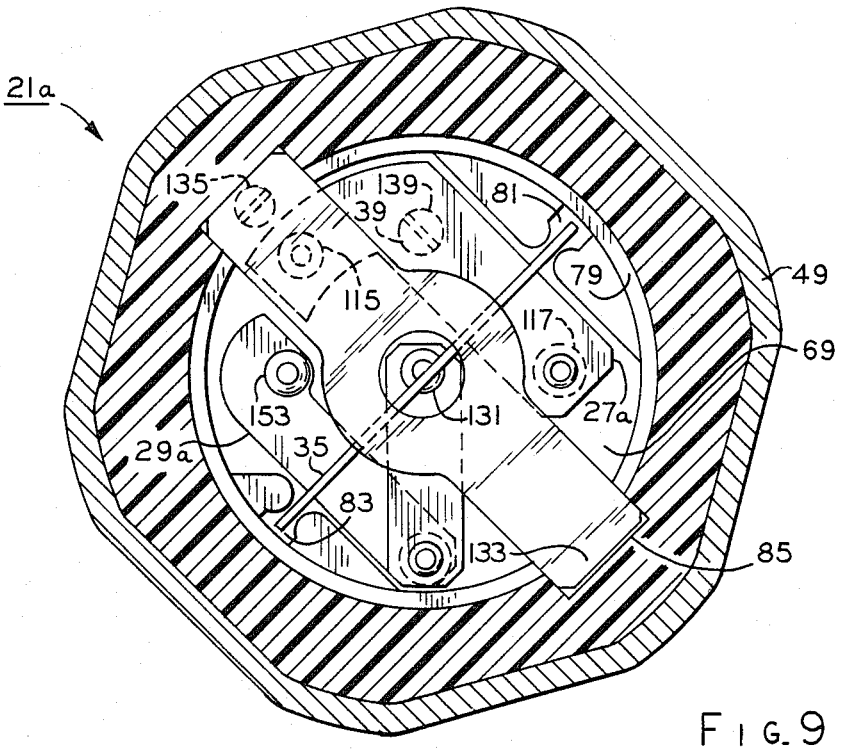
FIG. 9 is a sectional view taken along line 9—9 in FIG. 8.

Referring now to FIGS. 8 and 9, an alternative electric circuit controlling device **21*a* is shown having generally the same component parts and functioning generally in the same manner as the previously described device 21 with the exceptions noted hereinbelow. While device 21*a*** meets at least some of the objects set out hereinabove, it is also believed to have indigenous objects and advantageous features which will be in part apparent and in part pointed out in the following discussion.

In device **21*a*, it may be noted that switch elements 27*a*, 29*a* thereof are separate with switch element 27*a* being pivotally mounted to supporting section 115 of terminal 23. Another terminal 151 is mounted by suitable means to base wall 77 of lower housing member 45 having a supporting section 153 within switch chamber 69 to which switch element 27*a* is pivotally mounted. Thus, operation of switch elements 27*a*, 29*a* between their open and closed circuit positions or modes is effective to control separate circuits through device 21*a* between terminals 93, 153 and 23, 95**, respectively.

Figure 10:
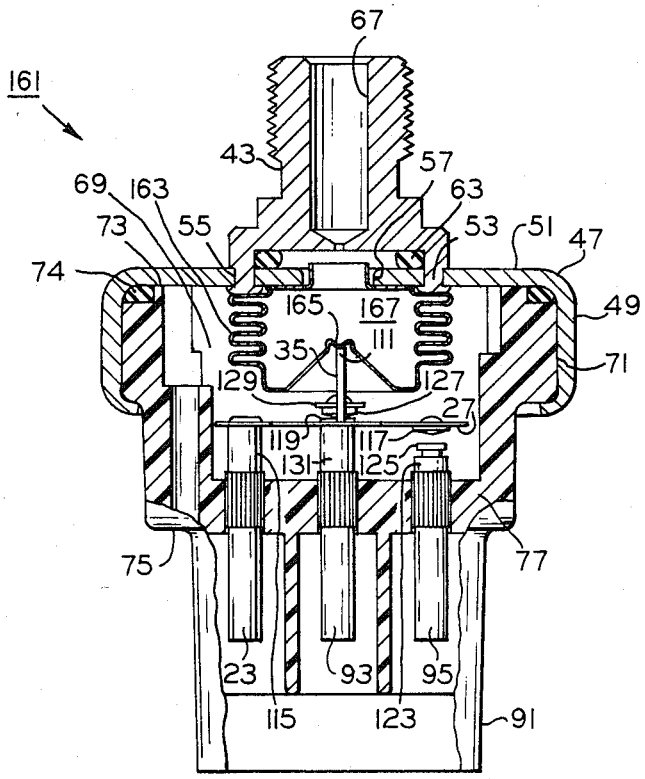
FIG. 10 is a sectional view showing another alternative electric circuit controlling device in one form of the invention.

Referring now to FIG. 10, another alternative electric circuit controlling device 161 is illustrated in one form of the invention having generally the same component parts and functioning generally in the same manner as the previously described device 21 with the exceptions noted hereinafter. While device 161 meets at least some of the objects set out hereinabove, it is also believed to have indigenous objects and advantageous features as will be in part apparent and in part pointed out in the following discussion.

In device 161, actuating member 35 is controllably operated or driven by means, such as a bellows 163 or other fluid pressure responsive member or the like for instance, operable generally for exerting the applied force F onto the actuating member. Bellows 163 may be formed of any suitable material and is secured to radial wall 51 of sleeve 49 generally about opening 57 therethrough by suitable means, such as soldering or welding or the like for instance (not shown). Bellows 163 extends downwardly from radial wall 51 of sleeve 49 into switch chamber 69, and a lower end or end portion 165 of the bellows is drivingly engaged with pivot section 111 of actuating member 35. A vacuum chamber 167 is defined within bellows 163, and the vacuum chamber arranged in communication with central port 67 which, in this form of the invention, is adapted for connection with a vacuum source (not shown). In the operation of device 161, bellows 163 is movable in response to a pressure differential established thereacross between vacuum chamber 167 and atmospheric pressure in switch chamber 69 to drive actuating member 35 and effect the switching operation of switch member 25 as previously discussed hereinbefore.

In view of the foregoing, it is now apparent that novel devices 21, 21*a*, 161 and novel methods of operating such are presented meeting the objects therefor as discussed above, as well as others, and that changes as to the precise configurations, arrangements, details and connections of such component parts illustrated herein by way of example as well as the precise order of the steps of such method, may be made by those having ordinary skill in the art without departing from the spirit of the invention or the scope of the invention as set out in the claims which follow.

What I claim as new and desire to secure by Letters Patent of the United States is:

1. An electric circuit controlling device comprising:

a housing having a switch chamber and a pressure fluid chamber therein;

diaphragm means movably disposed in said housing for separating said pressure fluid chamber and said switch chamber;

snap action means mounted in said switch chamber and adapted for successive discrete snap action movements from a stable configuration toward a pair of unstable configurations thereof;

means movable in said switch chamber for transmitting to said snap action means a force created in response to established fluid pressure in said pressure fluid chamber acting on said diaphragm means, said transmitting means including a piston having a pair of opposite end portions, one of said opposite end portions being arranged in driven engagement with said diaphragm means, and a pair of generally annular spaced means on the other of said opposite end portions of said piston for selective driving engagement with said snap action means to effect the successive discrete snap action movements from the stable configuration toward the unstable configurations thereof when the force transmitted from said diaphragm means to said one end portion of said piston attains a pair of different preselected levels, respectively;

a plurality of terminals mounted to said housing and extending into said switch chamber, two of said terminals each including a contact section within said switch chamber, and at least another one of said terminals including a supporting section within said switch chamber;

a resilient switch member in said switch chamber comprising a pair of generally laterally spaced apart switch elements each including a free end portion, said free end portion of one of said switch elements being urged toward a position in making engagement with said contact section of one of said two terminals and said free end portion of the other of said switch elements being urged toward a position broken from said contact section of the other of said two terminals, and bridge means for integral interconnection between said switch elements and spaced from said free end portions thereof, respectively, said switch member being secured to said supporting section of said at least another one terminal at least generally adjacent the interconnection of said bridge means with said one switch element;

means adjustably movable in said housing toward a preselected position for abutment with said other switch element; and actuating means for both rockable movement and reciprocal movement in said switch chamber and including a plurality of fulcrum sections pivotally engaged with said snap action means and said switch elements, respectively, said actuating means being rockably movable generally about its fulcrum sections engaged with said snap action means and said switch elements and also being protractively movable in said housing in response to the discrete snap action movement of said snap action means from its stable configuration to one of the unstable configurations thereof when the force transmitted to said piston attains one of the different preselected levels thereof so as to initially move said other switch element generally about said supporting section of said at least another one terminal into engagement with said abutment means and then pivot at least said free end portion of said other switch element generally about the engagement of said other switch element with said abutment means toward a position in making engagement with said contact section of said other of said two terminals and said actuating means being thereafter further only rockably movable generally about the pivotal engagement of one of its fulcrum sections with said other switch element in the making engagement thereof with said contact section of said other of said two terminals in response to the successive discrete snap action movement of said snap action means from its one unstable configuration to the other of the unstable configurations thereof when the force transmitted to said piston attains the other of the different preselected levels so as to move said other switch element generally about said supporting section of said at least another one terminal toward a position making the free end portion of said other switch element in engagement with said contact section of said one of said two terminals.

2. An electric circuit controlling device comprising:

a housing;

snap action means in said housing and adapted for successive discrete snap action movements from a stable configuration toward a pair of unstable configurations thereof;

means movable in said housing for transmitting a force to said snap action means and including a pair of different force applying portions for selective operating engagement with said snap action means to cause the successive discrete snap action movements from the stable configuration to the unstable configurations thereof at different preselected force levels, respectively;

a switch member including a pair of spaced apart switch elements each having a free end portion and movable generally between a pair of circuit controlling modes, respectively;

means for pivotally mounting said switch member in said housing; and actuating means arranged in pivoting engagement between said snap action means and said switching elements so as to be operable generally in response to the successive discrete snap action movements of said snap action means from the stable configuration to one of the unstable configurations thereof and from the one unstable configuration to the other of the unstable configurations thereof for successively effecting the movements of said switch elements generally about said pivotally mounting means of said switch member to urge said free end portions of said switch elements toward one of the circuit controlling modes thereof, respectively.

3. An electric circuit controlling device as set forth in claim 2 wherein said pivotally mounting means of said switch member is arranged in spaced relation closer to one of said switch elements.

4. An electric circuit controlling device as set forth in claim 2 wherein said switch member includes means for integral interconnection between said switch elements and spaced from said free end portions thereof, respectively, said integral interconnection means being mounted with said pivotally mounting means.

5. An electric circuit controlling device as set forth in claim 2 further comprising a fulcrum located in said housing, one of said switch elements being initially movable about said pivotally mounting means of said switch member into abutment with said fulcrum and a part of said one switch element being thereafter further movable about the abutment of said one switch element with said fulcrum to urge said free end portion of said one switch element toward the one circuit controlling mode thereof during the operation of said actuating means in response to the snap action movement of said snap action means from the stable configuration to the one unstable configuration thereof.

6. An electric circuit controlling device as set forth in claim 5 further comprising means adjustably movable in said housing for defining said fulcrum.

7. An electric circuit controlling device comprising:

a housing;

a switch member in said housing and including a pair of spaced apart switch elements movable generally between a pair of circuit controlling modes, respectively;

means for pivotally mounting said switch member in said housing;

fulcrum means located in said housing for abutment with one of said switch elements; and actuating means adapted for movement in said housing in response to an applied force thereon and arranged in pivotal bridging engagement between said switch elements, respectively, said actuating means being movable in response to the applied force acting thereon to initially move at least said one switch element generally about the pivotally mounting means of said switch means into engagement with said fulcrum means and then to further move a distal part of said one switch element generally about only said fulcrum means toward one of the circuit controlling modes of said one switch element, and said actuating means also being thereafter pivotally movable in response to the applied force acting thereon generally about the pivotal engagement of said actuating means with said one switch element when said at least one switch element is in its one circuit controlling mode and in its abutment with said fulcrum means so as to move the other of said switch elements generally about the pivotally mounting means of said switch member toward one of the circuit controlling modes of said other switch element.

8. An electric circuit controlling device as set forth in claim 7 further comprising snap action means in said housing initially operable generally with discrete snap action movement between a stable configuration and an unstable configuration for exerting the applied force at a preselected level on said actuating to effect the movement of said one switch element toward its one circuit controlling mode and thereafter successively operable with discrete snap action movement between the first named unstable configuration and another unstable configuration for exerting the applied force at an increased preselected level on said actuating means to effect the movement of said other switch element toward its one circuit controlling mode.

9. An electric circuit controlling device as set forth in claim 8 further comprising means movable in said housing for transmitting force onto said snap action means to effect its discrete successive snap action movements, said force transferring means including a pair of generally annular means for selective driving engagement with said snap action means during the discrete successive snap action movements thereof, respectively.

10. An electric circuit controlling device as set forth in claim 7 further comprising means adjustably movable in said housing toward a preselected position with respect to said one switch element and including said fulcrum means.

11. An electric circuit controlling device as set forth in claim 7 further comprising fluid pressure responsive means movable in said housing for exerting the applied force onto said actuating means.

12. An electric circuit controlling device as set forth in claim 11 wherein said fluid pressure responsive means comprises a bellows.

13. An electric circuit controlling device comprising:

a housing;

a switch member in said housing comprising a pair of generally laterally spaced apart switch elements each having a free end portion and operable generally between a pair of circuit controlling positions, respectively, and including means for integral interconnection between said switch elements and spaced from said free end portions thereof, respectively;

means arranged in supporting engagement with said interconnection means in spaced relation closer to one of said switch elements than the other of said switch elements for pivotally mounting said switch member in said housing;

fulcrum means adjustably movable in said housing toward a preselected position with respect to one of said one and other switch elements for abutment therewith; and actuating means movable in said housing in response to an applied force thereon and arranged for pivotal bridging engagement with said switch elements to effect the operations thereof from one of the circuit controlling positions toward the other of the circuit controlling positions thereof, respectively, said actuating means being movable in response to the applied force acting thereon to initially move said one of said one and other switch elements from its one circuit controlling position generally about said pivotally mounting means into abutment with said fulcrum means and then move at least said free end portion of said one of said one and other switch elements about said abutment means toward the other circuit controlling position of said one of said one and other switch elements, and said actuating means also being thereafter further movable in response to the applied force acting thereon generally pivotally about said one of said one and other switch element when said one of said one and other switch elements is in its other circuit controlling position and in the abutting engagement thereof with said fulcrum means to move the other of said one and other switch elements from its one circuit controlling position generally about said pivotally mounting means toward the other circuit controlling position of said other of said one and other switch elements.

14. An electric circuit controlling device as set forth in claim 13 further comprising a bellows movable in said housing in response to the establishment of a pressure differential thereacross to exert the applied force on said actuating means.

15. An electric circuit controlling device comprising:

a housing;

snap action means in said housing and operable generally for successive discrete snap action movements from a stable configuration toward a pair of unstable configurations thereof, respectively;

a pair of switch elements mounted in said housing so as to be pivotally movable between a pair of circuit controlling modes, respectively; and actuating means movable in said housing and bridged in pivoting engagement between said snap action means and said switch elements for effecting successive pivotal movements of said switch elements between the circuit controlling modes thereof, respectively, said actuating means being initially movable to effect the pivotal movement of one of said switch elements from one of the circuit controlling modes to the other thereof upon the discrete snap action movement of said snap action means from the stable configuration toward one of the unstable configurations thereof and said actuating means also being thereafter further movable so as to pivot generally about its pivoting engagement with said one switch element when said one switch element is in its other circuit controlling mode to subsequently effect the pivotal movement of the other of said switch elements from one of the circuit controlling modes to the other thereof upon the successive discrete snap action movement of said snap action means from the one unstable configuration to the other of the unstable configurations thereof.

16. A method of operating an electric circuit controlling device having means therein for pivotally mounting a switch member with the switch member including a pair of spaced apart switch elements each having a free end portion and operable generally between a pair of circuit controlling modes, respectively, a fulcrum, and actuating means for pivotal bridging engagement between the switch elements, respectively, the method comprising the steps of:

exerting an applied force of a preselected level on the actuating means;

moving generally conjointly the actuating means and one of the switch elements in response to the applied force of the preselected level exerted on the actuating means and effecting thereby the pivotal movement of the one switch element generally about the pivotally mounting means of the switch member;

abutting the one switch element with the fulcrum in response to the pivotal movement of the one switch element generally about the pivotally mounting means of the switch member;

moving further and generally conjointly the actuating means and a part of the one switch element with the one switch element part being pivoted generally about the fulcrum in response to the applied force of the preselected level exerted on the actuating means and urging thereby the free end portion of the one switch element toward one of the circuit controlling modes thereof;

increasing the applied force exerted on the actuating means to another preselected level predeterminately greater than the first named preselected level; and pivoting the actuating means in response to the applied force of the another preselected level exerted thereon generally about the pivoting engagement of the actuating means with the one switch element when the one switch element is in the one circuit controlling mode thereof and abutted with the fulcrum and moving thereby the other of the switch elements generally about the pivotally mounting means of the switch member to urge the free end portion of the other switch element toward one of the circuit controlling modes thereof in response to the pivoting of the actuating means generally about the one switch element.

17. The method as set forth in claim 13 wherein the electric circuit controlling device further includes snap action means drivingly engaged with the actuating means and adapted for successive discrete snap action movements from a stable configuration to a pair of unstable configurations thereof and wherein the exerting step includes displacing the snap action means with the discrete snap action movement from the stable configuration to one of the unstable configurations thereof.

18. The method as set forth in claim 14 wherein the increasing step includes displacing further the snap action means with the discrete snap action movement from the one unstable configuration to the other of the unstable configurations thereof.

19. The method as set forth in claim 13 comprising the preliminary step of adjusting the fulcrum to a preselected position spaced from the one switch element when the switch member is in an at rest position thereof.

20. A method of operating an electric circuit controlling device having means for pivotally mounting a switch member therein with the switch member including a pair of spaced apart switch elements operable generally between at least a pair of circuit controlling modes, snap action means adapted for successive discrete snap action movements from a stable configuration toward at least a pair of unstable configurations thereof, respectively, and actuating means for pivotal bridging engagement between the snap action means and the switch elements, respectively, the method comprising the steps of:

displacing the snap action means through one of its discrete snap action movements from the stable configuration toward one of the unstable configurations thereof and moving generally conjointly the actuating means and one of the switch elements in response to the discrete snap action movements of the snap action means so as to move the one switch element generally about the pivotally mounting means of the switch member toward one of the circuit controlling modes of the one switch element; and displacing the snap action means through a successive one of its discrete snap action movements from the one unstable configuration to another of the unstable configurations thereof and pivoting the actuating means in response to the successive one discrete snap action movement of the snap action means generally about the pivotal bridging engagement of the actuating means with the one switch element when the one switch element is in the one circuit controlling mode thereof so as to move the other of the switch elements generally about the pivotally mounting means of the switch member toward one of the circuit controlling modes of the other switch element.

21. The method as set forth in claim 20 wherein the electric circuit controlling device further has a fulcrum therein and wherein the displacing and moving step includes engaging the one switch element with the fulcrum during the pivotal movement of the one switch element toward the one circuit controlling mode thereof.

22. A method of operating an electric circuit controlling device having a fulcrum, and means for pivotally mounting a switch member with the switch member including a pair of spaced apart switch elements each having a free end portion and operable generally between a pair of circuit controlling modes, respectively, the method comprising the steps of:

moving one of the switch elements generally about the pivotally mounting means of the switch member and abutting the one switch element with the fulcrum;

pivoting the one switch element generally about its abutment with the fulcrum and urging thereby the free end portion of the one switch element toward one of the circuit controlling modes thereof; and thereafter moving the other of the switch elements independently of the one switch element and generally about the pivotally mounting means of the switch member and urging thereby the free end portion of the other switch element toward one of the circuit controlling modes thereof.

23. A method of operating an electric circuit controlling device having a fulcrum, snap action means adapted for successive discrete snap action movement from a stable configuration toward at least a pair of unstable configurations, a pair of switch elements movable between at least a pair of switching modes thereof, respectively, and actuating means for pivotal engagement between the snap action means and the switch elements, the method comprising the steps of:

displacing the snap action means from the stable configuration to one of the unstable configurations thereof;

moving at least generally conjointly the actuating means and one of the switch elements to initially engage the one switch element with the fulcrum and then displacing a part of the one switch element generally about the fulcrum toward one of the circuit controlling modes of the one switch element in response to the displacement of the snap action means;

displacing further the snap action means from the one unstable configuration to another of the unstable configurations thereof; and pivoting the actuating means generally about its pivotal bridging engagement with the one switch element in its one circuit controlling mode and its abutment with the fulcrum and moving thereby the other of the switching elements toward one of the circuit controlling modes thereof in response to the further displacement of the snap action means.

24. An electric circuit controlling device comprising:

a housing;

a pair of means movable in said housing and operable generally for switching between at least a pair of circuit controlling modes, respectively;

actuating means arranged in bridging pivotal engagement between at least said switching means and pivotally movable in response to an applied force exerted thereon for effecting the operation of said switching means, respectively, said actuating means being pivotally movable upon the exertion thereon of the applied force at a preselected level to effect the operation of one of said switching means into one of the circuit controlling modes thereof, and said actuating means being thereafter further pivotally movable with respect to said one switching means in the one circuit controlling mode thereof upon the exertion on said actuating means of the applied force at another preselected level in excess of the first named preselected level to effect the operation of the other of said switching means toward one of the circuit controlling modes thereof.

25. An electric circuit controlling device as set forth in claim 24 further comprising means in said housing associated with said actuating means and operable generally for exerting the applied force at the first named and another preselected levels onto said actuating means.

26. An electric circuit controlling device as set forth in claim 25 wherein said applied force exerting means comprises snap action means operable generally between a stable configuration and a first unstable configuration thereof and thereafter between the first unstable configuration and at least another unstable configuration thereof for respectively effecting the exertion of the applied force at the first named and another preselected levels onto said actuating means.

27. An electric circuit controlling device as set forth in claim 25 wherein said applied force exerting means comprises a bellows operable in said housing in response to the establishment of pressure differentials at first and second preselected values thereacross to exert the applied force at the first named and another preselected levels on said actuating means, respectively.

28. An electric circuit controlling device as set forth in claim 24 further comprising fulcrum means arranged in said housing for engagement with a part of said one switching means upon the operation of said one switching means toward the one circuit controlling mode thereof.

29. A method of operating an electric circuit controlling device having a pair of means for switching between at least a pair of circuit controlling modes, respectively, and actuating means for bridging pivotal engagement between at least the switching means, the method comprising the steps of:

exerting an applied force of a preselected value onto the actuating means and effecting thereby movement of the actuating means and one of the switching means toward a position in the device disposing the one switching means is one of the circuit controlling modes thereof; and then increasing the applied force exerted on the actuating means to another preselected value in excess of the first named preselected value and pivoting thereby the actuating means with respect to the one switching means in the one circuit controlling mode thereof to effect movement of the other of the switching means toward one of the circuit controlling modes thereof.

* * * * *